US008162778B1

(12) United States Patent
Rollinson et al.

(10) Patent No.: US 8,162,778 B1
(45) Date of Patent: Apr. 24, 2012

(54) COMBINATION TOOL FOR GOLF

(75) Inventors: Augustin W. Rollinson, Carlsbad, CA (US); Craig E. Abbott, Vista, CA (US); Bradley C. Rice, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 13/043,122

(22) Filed: Mar. 8, 2011

Related U.S. Application Data

(63) Continuation of application No. 29/385,609, filed on Feb. 16, 2011, now Pat. No. Des. 642,029, and a continuation of application No. 29/386,019, filed on Feb. 23, 2011, now Pat. No. Des. 649,214.

(51) Int. Cl.
*A63B 57/00* (2006.01)

(52) U.S. Cl. ..... 473/408

(58) Field of Classification Search ..... 473/408, 473/286; D21/793
See application file for complete search history.

(56) References Cited

U.S. PATENT DOCUMENTS

| | | | | | |
|---|---|---|---|---|---|
| D218,836 | S | * | 9/1970 | Watanabe | D21/793 |
| 4,535,987 | A | * | 8/1985 | Dikoff | 473/406 |
| D285,233 | S | * | 8/1986 | Owen | D21/793 |
| 5,054,777 | A | * | 10/1991 | Borden et al. | 473/406 |
| D361,815 | S | * | 8/1995 | Fazekas | D21/793 |
| 5,643,114 | A | | 7/1997 | Marcus | |
| 5,645,500 | A | | 7/1997 | Borden | |
| 5,733,208 | A | | 3/1998 | Fazekas | |
| 5,782,708 | A | | 7/1998 | Kimball, Jr. | |
| D403,733 | S | * | 1/1999 | Collias | D21/793 |
| 6,004,229 | A | | 12/1999 | Fazekas | |
| 6,030,298 | A | * | 2/2000 | Tate | 473/408 |
| 6,040,772 | A | | 3/2000 | Jackson et al. | |
| 6,048,274 | A | * | 4/2000 | Lesage | 473/286 |
| 6,050,905 | A | * | 4/2000 | Tate | 473/408 |
| 6,112,364 | A | | 9/2000 | Myers | |
| 6,363,941 | B1 | | 4/2002 | Combs | |
| 6,407,667 | B1 | | 6/2002 | Jackson et al. | |
| 6,413,173 | B1 | | 7/2002 | Muller et al. | |
| 6,796,913 | B2 | * | 9/2004 | Tummillo | 473/408 |
| 7,189,166 | B2 | | 3/2007 | Pare | |
| 7,494,431 | B2 | * | 2/2009 | Wang | 473/408 |
| 7,766,769 | B2 | | 8/2010 | Lueders | |
| 7,850,550 | B2 | | 12/2010 | Nania et al. | |
| 2005/0288122 | A1 | | 12/2005 | Pare | |
| 2006/0178225 | A1 | | 8/2006 | Hall | |
| 2007/0149325 | A1 | | 6/2007 | Vargas | |
| 2008/0230435 | A1 | | 9/2008 | Cope | |
| 2009/0163300 | A1 | | 6/2009 | Leuders | |
| 2009/0239677 | A1 | * | 9/2009 | DeShiell et al. | 473/289 |

FOREIGN PATENT DOCUMENTS

| | | | |
|---|---|---|---|
| DE | 202004015352 | U1 * | 6/2005 |
| WO | 9810841 | | 3/1998 |
| WO | WO98/10841 | | 9/1998 |
| WO | 9910051 | | 3/1999 |
| WO | WO99/10051 | | 3/1999 |
| WO | 0019390 | | 4/2000 |
| WO | 2006000106 | | 1/2006 |
| WO | WO2006/000106 | | 1/2006 |

* cited by examiner

*Primary Examiner* — Steven Wong
(74) *Attorney, Agent, or Firm* — Rebecca Hanovice; Michael A. Catania; Sonia Lari

(57) ABSTRACT

A combination turf repair tool and golf club adjustment tool is disclosed herein. One embodiment of the combination tool comprises a turf repair portion connected to a golf club adjustment portion, and a cover portion or cap that is sized to cover at least part of the golf club adjustment portion. The cap or cover portion may be a separate, removable piece, or may be pivotally attached to another part of the tool. Another embodiment of the combination tool comprises a turf repair portion and a golf club adjustment portion, wherein the golf club adjustment portion is pivotally attached to the turf repair portion.

9 Claims, 5 Drawing Sheets

COMBINATION TOOL FOR GOLF

CROSS REFERENCES TO RELATED APPLICATIONS

The present application is a continuation in part of U.S. Design patent application Nos. 29/385,609, filed on Feb. 16, 2011, 29/386,018, filed on Feb. 23, 2011, and 29/386,019, filed on Feb. 23, 2011.

STATEMENT REGARDING FEDERALLY SPONSORED RESEARCH OR DEVELOPMENT

Not Applicable

BACKGROUND OF THE INVENTION

1. Field of the Invention

The present invention relates to a tool that combines a turf repair tool and a hex wrench or screwdriver for making alterations and adjustments to a golf club head.

2. Description of the Related Art

The golf industry provides golf enthusiasts with a myriad of products and tools to use during their golf games. For example, golf etiquette requires golfers to repair divots or damage to the turf when they are golfing. Such divots are often called "pitch marks." As such, golfers typically carry divot (or pitch) repair tools. Furthermore, with the recent advent and popularity of golf club adjustability technology, more and more golfers are playing with adjustable golf clubs. These clubs allow golfers to adjust features such as loft, lie, face angle, and weight, thus allowing golfers to customize their clubs.

Weight adjustment technology often involves the use of removable weights which can be affixed to the golf club head via screws or bolts. A golfer who plays with a weight adjustable club head and wishes to make rapid, in-game adjustments to the club will have to carry a wrench or screwdriver to tighten and loosen attached weights. As such, in order to be able to make necessary adjustments to their club, as well as to repair divots or pitch marks in the turf caused by use of said club, golfers must carry at least two tools in their bags or on their person. By increasing the number of tools a golfer carries, he or she increases the likelihood of losing one or more of these tools because there are more items of which the golfer must keep track.

BRIEF SUMMARY OF THE INVENTION

The present invention is directed to a combination tool that includes a divot repair aspect and a hex wrench or screwdriver aspect, such that a golfer needs to carry (and keep track of) only one tool to repair damage to turf and to adjust features of his or her golf club.

One aspect of the present invention is a golf tool comprising a turf repair portion, a golf club adjustment portion, and a cap sized to cover at least part of the golf club adjustment portion. The cap may be removably attached to the golf club adjustment portion. The tool may further comprise a middle portion connecting the turf repair portion to the golf club adjustment portion, and the cap may be pivotally attached to the middle portion. The turf repair portion may be a forked divot repair feature and the golf club adjustment portion may be a TORX® wrench, a hex wrench, or a screwdriver. The cap, when attached to the golf club adjustment portion, may cover the entirety of the golf club adjustment portion, or may cover only a top and two sides of the golf club adjustment portion. The golf tool may have a maximum length of 2 to 5 inches and a maximum width of 0.5 to 1.5 inches. The turf repair portion may comprise plastic, and the golf club adjustment portion may comprise steel.

Another aspect of the present invention is a golf tool comprising a turf repair portion and a golf club adjustment portion, wherein the golf club adjustment portion is pivotally attached to the turf repair portion. The turf repair portion may be a forked divot repair feature, and the golf club adjustment portion may be a TORX® wrench, a hex wrench, or a screwdriver. The turf repair portion may comprise plastic and the golf club adjustment portion may comprise steel. The turf repair portion may further comprise a recess sized to receive the golf club adjustment portion.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
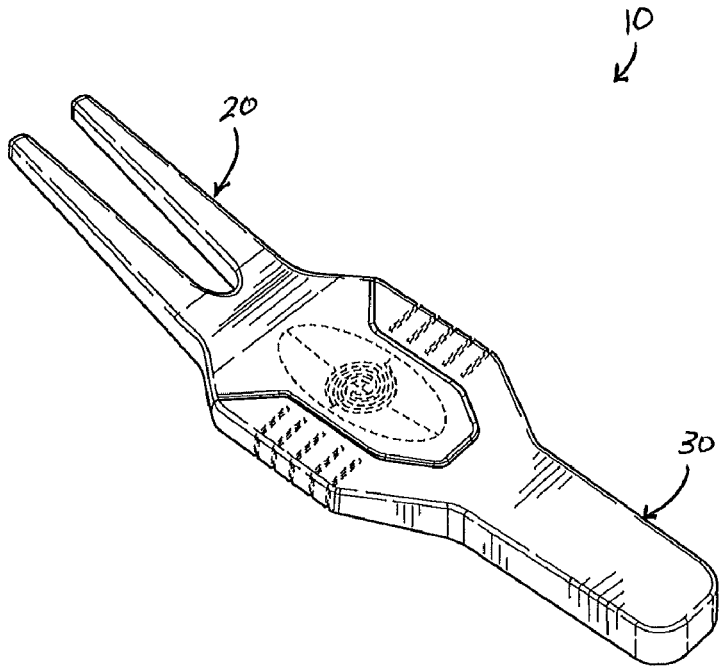
FIG. 1 a top perspective view of a combination tool according to a first embodiment of the present invention.
Figure 2:
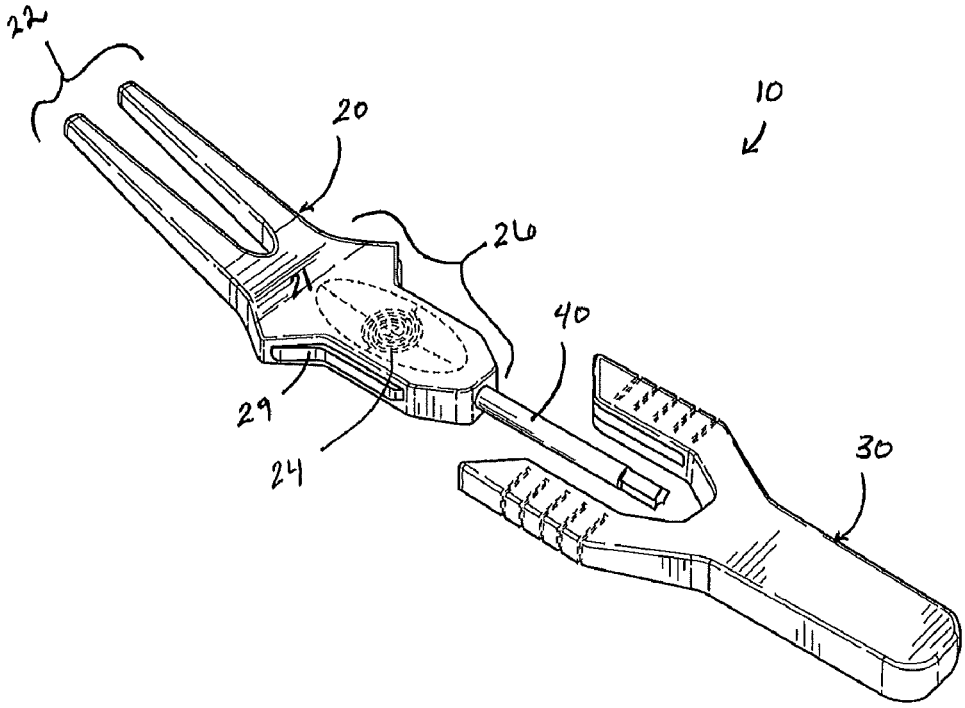
FIG. 2 is an exploded view of the combination tool shown in FIG. 1.

The present invention is directed to a combination tool that includes a divot repair aspect and golf club adjustment portion, which may be a TORX® wrench, hex wrench, or screwdriver, such that a golfer needs to carry only one tool to repair damage to turf and to adjust features of his or her golf club.

FIGS. 1-5D show a preferred embodiment of the combination tool 10 of the present invention. This embodiment has a two-part construction comprising a tool portion 20 and a cover portion 30. When the tool and cover portions 20, 30 are fully assembled to form the combination tool 10, as shown in FIGS. 1, 3A, 3B, 3C, and 3D, the tool 10 has a total length L from the end of the tool portion 20 to the end of the cover portion 30 of 3.50 to 4.50 inches, and most preferably 3.845 inches, a maximum width W of 0.50 to 1.50 inches, and most preferably 1.024 inches, and a maximum thickness T of 0.100 to 0.400, and most preferably 0.223.

As shown in FIGS. 2-4E, the tool portion 20 has a front side 21, a back side 23, a left side 25, and a right side 27, and includes a turf repair section 22 and a TORX® wrench 40. In an alternative embodiment, the TORX® wrench 40 may be replaced with a hex wrench or a screwdriver. The turf repair section 22 is connected to the TORX® wrench 40 by a middle section 26, which is sized to display a logo or decoration 24, preferably on the front side 21. The turf repair section 22 preferably is forked into two prongs 22*a*, 22*b* which, when the tool 10 is laid flat on its back side 23 along a ground plane 15 as shown in FIGS. 3B and 4C, are angled upwards and form an angle A1 with the ground plane 15 between 15 and 20 degrees, and most preferably 18.8 degrees. As shown in FIG. 4B, the prongs 22*a*, 22*b* form an angle A2 of between 2 and 6 degrees from each other, and most preferably 4 degrees from each other. The tops of the prongs 22*a*, 22*b* have a distance D1 from the ground plane 15 of 0.25 to 1.00 inch, and most preferably 0.584 inch, and a distance D2 from the front side 21 of the tool portion 20 of 0.200 to 0.500 inch, and most preferably 0.361 inch.

Figure 4A:
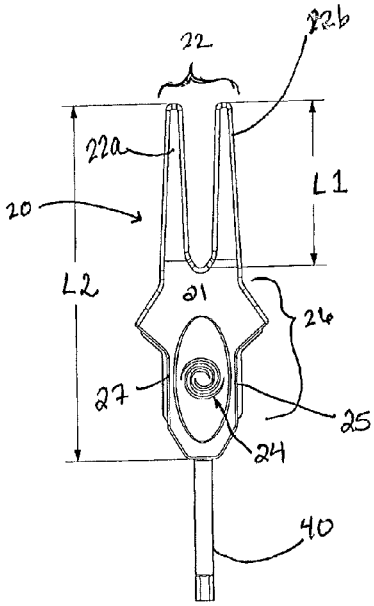
FIG. 4A is a top plan view of the tool portion of the combination tool shown in FIG. 1.
Figure 3A:
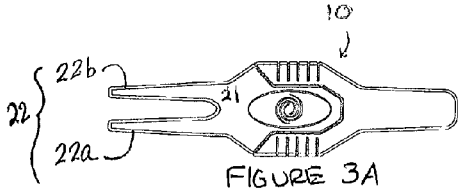
FIG. 3A is a top plan view of the combination tool shown in FIG. 1.
Figure 3B:
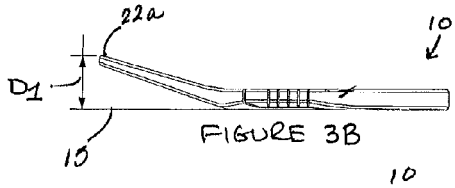
FIG. 3B is a side view of the combination tool shown in FIG. 1.
Figure 3C:
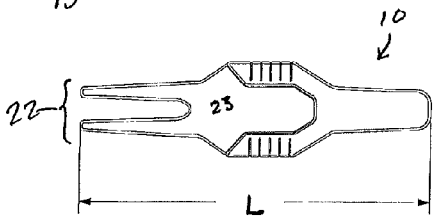
FIG. 3C is a bottom plan view of the combination tool shown in FIG. 1.
Figure 4D:
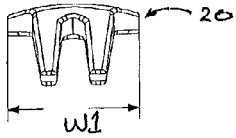
FIG. 4D is a front side view of the tool portion of the combination tool shown in FIG. 1.
Figure 3D:
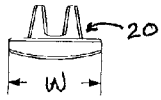
FIG. 3D is a back side view of the combination tool shown in FIG. 1.
Figure 4B:
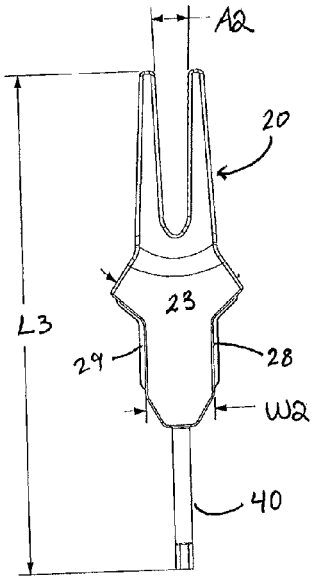
FIG. 4B is a bottom plan view of the tool portion of the combination tool shown in FIG. 1.
Figure 4C:
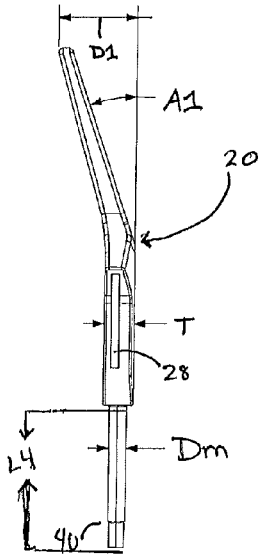
FIG. 4C is a side view of the tool portion of the combination tool shown in FIG. 1.
Figure 4E:
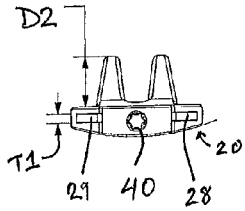
FIG. 4E is a back side view of the tool portion of the combination tool shown in FIG. 1.

As shown in FIG. 4A, the turf repair section 22 preferably has a length L1 of 0.75 to 1.50 inches long, and most preferably of 1.194 inches long. The turf repair section 22 in combination with the middle section 26 preferably has a length L2 of 2 to 3 inches long, and most preferably of 2.577 inches long. As shown in FIG. 4B, the tool portion 20 preferably has a total length L3 of 3 to 4 inches long, and most preferably of 3.6 inches long. As shown in FIGS. 4D and 4B, respectively, the tool portion 20 has a maximum width W1 of 0.50 to 1.50 inches, and most preferably 0.974 inch, and a medium width W2 of 0.400 to 0.600 inch, and most preferably 0.508 inch. The tool portion 20 has a maximum thickness T of 0.100 to 0.400, and most preferably 0.223 as shown in FIG. 4C.

The tool portion 20 further has protrusions 28, 29 extending from the left and right sides 25, 27 to engage the cover portion 30 and hold it in place. The protrusions 28, 29 are shown in FIGS. 2, 4A, 4B, 4C, and 4E. These protrusions 28, 29 are between 0.050 and 0.085 inch wide, and most preferably 0.075 inch wide, and have a thickness T1 of 0.025 to 0.080 inch, and most preferably 0.067 inch.

The TORX® wrench 40 of the tool portion 20 has a length L4 of 0.50 to 1.50 inches, and preferably approximately 1.00 inch, and a diameter Dm of 0.050 to 0.200 inch, and preferably 0.128 inch. The TORX® wrench 40 preferably is composed of a steel material, and more preferably of 1045 carbon steel. In alternative embodiments that include a hex wrench or a screwdriver instead of a TORX® wrench, the hex wrench or screwdriver also preferably are composed of a steel material.

As shown in FIGS. 5A-5D, the cover portion 30 is a unitary piece having a length L6 of 2.00 to 4.00 inches, and most preferably 2.244 inches, and a maximum thickness T equivalent to the maximum thickness T of the tool portion 20. The upper part of the cover portion 30 is forked into two extension portions 31, 32 that, when the combination tool 10 is fully assembled, receive the tool portion 20 and cover at least part of the left and right sides 25, 27 of the tool portion 20.

Figure 5A:
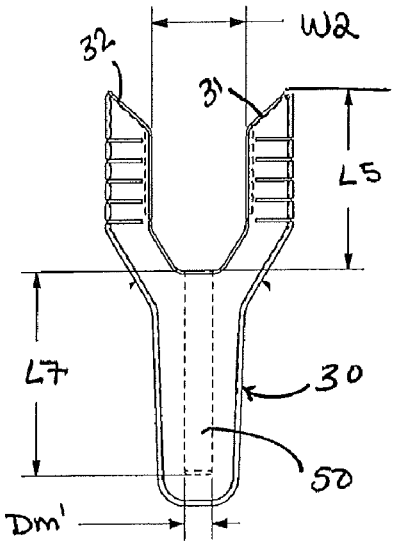
FIG. 5A is a top plan view of the cover portion of the combination tool shown in FIG. 1.
Figure 5B:
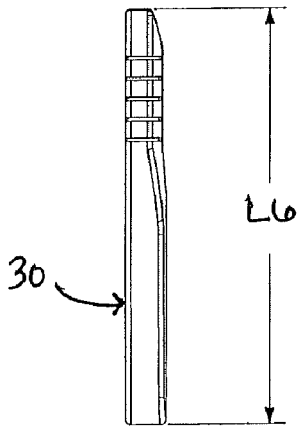
FIG. 5B is a side view of the cover portion of the combination tool shown in FIG. 1.
Figure 5C:
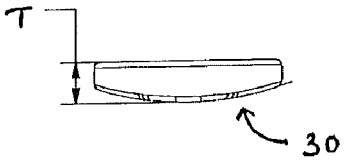
FIG. 5C is a back side view of the cover portion of the combination tool shown in FIG. 1.
Figure 5D:
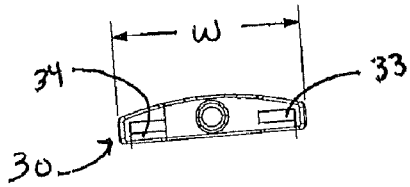
FIG. 5D is a front side view of the cover portion of the combination tool shown in FIG. 1.

The extension portions 31, 32 each have a length L5 of 0.75 to 1.50 inch, and most preferably 0.976 inch. The extension portions 31, 32 are spaced from each other to receive part of the middle portion 26 of the tool portion 20, and particularly the part of the tool portion 20 having a medium width W2. As such, the extension portions 31, 32 are spaced from each other at least as many inches as the medium width W2 of the tool portion 20. The extension portions 31, 32 also each include a depression 33, 34 to receive the protrusions 28, 29 on the tool portion 20, as shown in FIG. 5D. The depressions 33, 34 are spaced from each other and sized to snugly but removably receive the protrusions 28, 29.

The cover portion 30 further includes a bore 50 having a length L7 of 0.750 to 1.50 inches, and most preferably 1.100 inches, and having single opening at the fork between the extension portions 31, 32. The bore is sized to receive and cover the TORX® wrench 40, and thus has a diameter Dm' that is at least equivalent to the diameter of the hex wrench 40 Dm, and preferably is 0.148 inch.

The turf repair section 22, middle section 26, and cover portion 30 of the combination tool 10 preferably are composed of a moldable plastic. In alternative embodiments, these sections of the combination tool 10 may be composed of lightweight metal materials, such as aluminum alloys, magnesium alloys, and titanium alloys, or composite materials.

Figure 6:
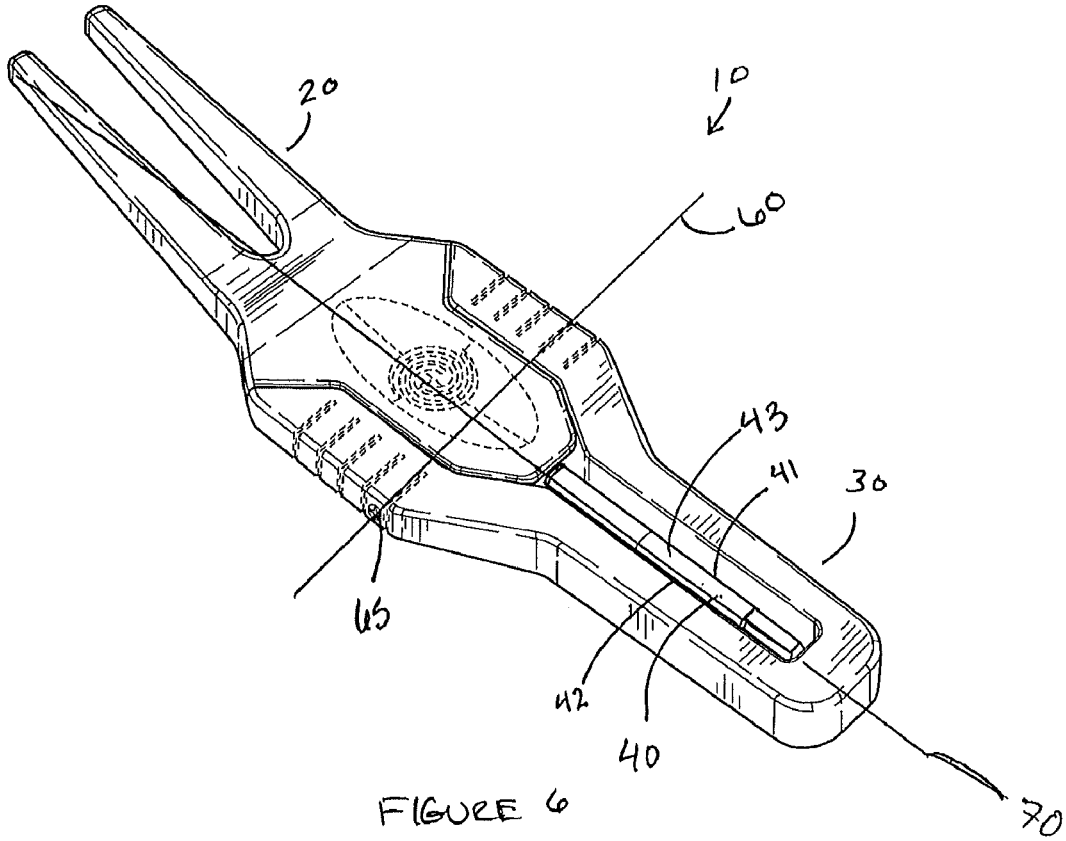
FIG. 6 is a top perspective view of a combination tool according to a second embodiment of the present invention.
Figure 7:
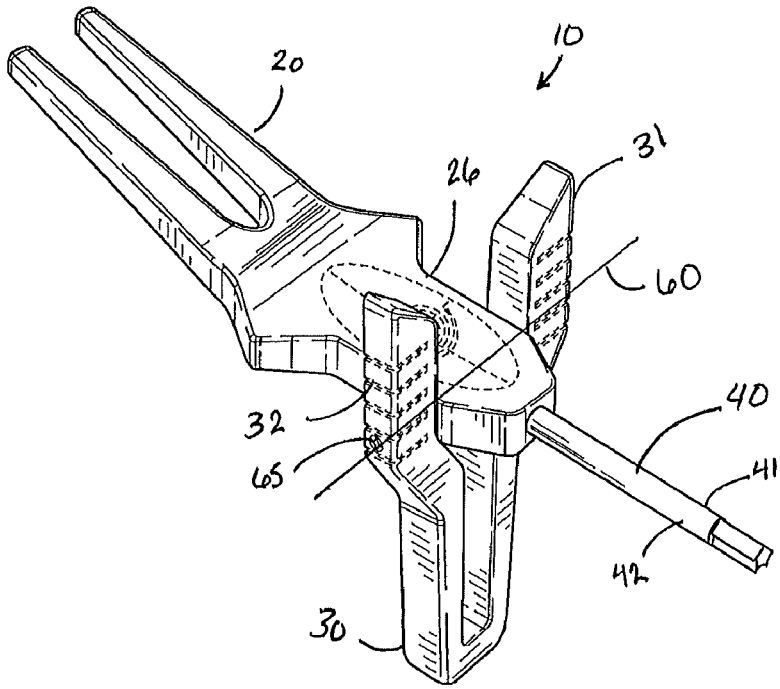
FIG. 7 is an exploded view of the combination tool shown in FIG. 6.

FIGS. 6 and 7 show a second embodiment of the present invention. The tool portion 20 of this embodiment has the same dimensions and is made of the same material as the tool portion 20 of the first embodiment. The cover portion 30 has many of the same dimensions and is made of the same material as the cover portion 30 of the first embodiment, but differs in several ways.

First, the cover portion 30 is pivotally attached to the tool portion 20 along rotation axis 60. In this embodiment, the extension portions 31, 32 of the cover portion 30 are attached to the left and right sides 25, 27 of the middle section 26 of the tool portion 20 with one or more screws or pins 65. Instead of removing the tool portion 20 from the cover portion 30 to access the hex wrench 40, the tool portion 20 is pivoted around the rotation axis 60 such that the TORX® wrench 40 is completely exposed.

The cover portion 30 of the second embodiment also differs from that of the first embodiment because, when the majority of the tool portion 20 shares a plane 70 with the cover portion 30 as shown in FIG. 6, the cover portion 30 only partially covers the TORX® wrench 40. Specifically, the cover portion 30 covers two sides 41, 42 of the TORX® wrench 40, but not the front side 43 or the back side (not shown) of the TORX® wrench 40. In this way, the cover portion 30 allows the TORX® wrench 40 to be pivoted with the rest of the tool portion 20 around the rotation axis 60 and become exposed for use.

Figures 8, 9:
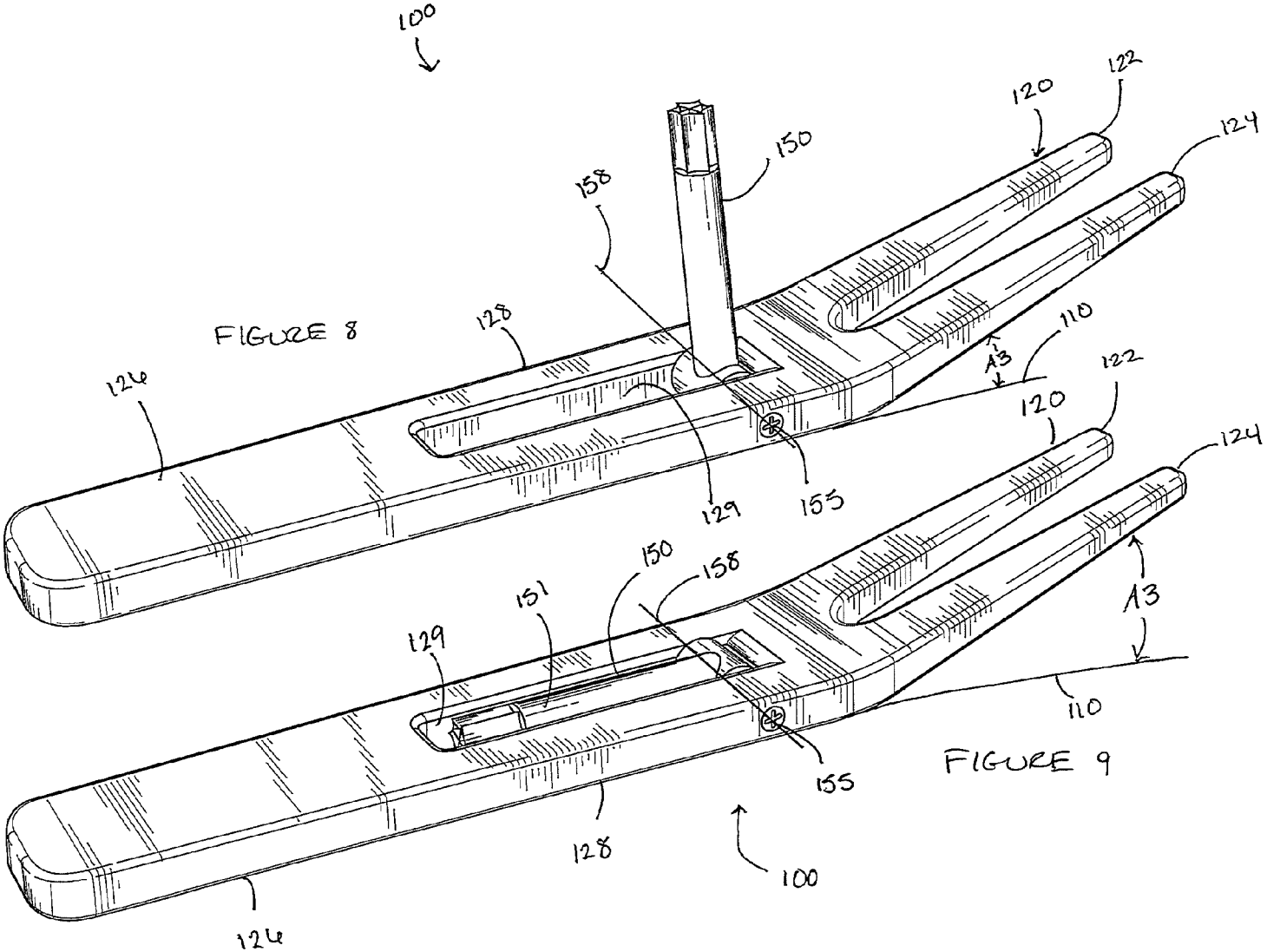
FIG. 8 is a top perspective view of a combination tool according to a third embodiment of the present invention, with a golf club adjustment portion raised.
FIG. 9 is a top perspective view of the combination tool shown in FIG. 8, with the golf club adjustment portion lowered.

FIGS. 8 and 9 show a third embodiment of the present invention. In this embodiment, the combination tool 100 has a turf repair portion 120 and a golf club adjustment portion 150. The turf repair portion 120 includes two prongs 122, 124 angled upwards from a ground plane 110 at a desired angle A3, a handle portion 126, and a middle portion 128 comprising a rectangular depression 129 sized to hold the golf club adjustment portion 150. The golf club adjustment portion 150, which may be a hex wrench or a screwdriver, but is preferably a TORX® wrench, is pivotally fixed within the rectangular depression 129 with a screw or pin 155. The turf repair portion 120 is preferably composed of a moldable plastic and the golf club adjustment portion 150 is preferably composed of steel, most preferably carbon steel. The turf repair portion 120 may have many of the same dimensions as the turf repair section 22 of the first embodiment described herein, particularly with respect to the prongs 122, 124.

When a user needs to access the TORX® wrench of the third embodiment, he or she can pull it upwards out of the depression 129, thereby rotating it around a rotation axis 158 defined by the screw or pin 155 such that the TORX® wrench is fully exposed and ready for use. When the user is finished using the TORX® wrench, he or she can rotate it around the rotation axis 158 again so that the TORX® wrench is completely disposed within the depression 129 such that only one side 151 of the TORX® wrench is visible.

In all embodiments of the present invention, the golf club adjustment tool may be used to adjust weighting of the club, adjust various angles such as loft, lie, and face, and adjust other elements of the golf club that are designed to be adjustable. The turf repair tool may be used to repair various types of damage to the terrain of a golf course during play.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf tool comprising:

a turf repair portion;

a golf club adjustment portion;

a middle portion connecting the turf repair portion to the golf club adjustment portion; and a cap sized to cover at least part of the golf club adjustment portion, wherein the cap is removably attached to the golf club adjustment portion, wherein the cap has at least one depression in each of at least two sides, wherein the middle portion has at least one protrusion extending from each of at least two sides, wherein the depressions receive the protrusions to engage the cap and hold it in place, wherein the tool has a maximum length of 2 to 5 inches, and wherein the tool has a maximum width of 0.5 to 1.5 inches.

2. The golf tool of claim 1, wherein the cap is pivotally attached to the middle portion.

3. The golf tool of claim 1, wherein the turf repair portion is a forked divot repair feature.

4. The golf tool of claim 1, wherein the golf club adjustment portion is selected from the group consisting of a hex wrench, a TORX® wrench, and a screwdriver.

5. The golf tool of claim 4, wherein the golf club adjustment portion is a TORX® wrench.

6. The golf tool of claim 1, wherein the cap, when attached to the golf club adjustment portion, covers the entirety of the golf club adjustment portion.

7. The golf tool of claim 1, wherein the cap, when attached to the golf club adjustment portion, covers only a top and two sides of the golf club adjustment portion.

8. The golf tool of claim 1, wherein the turf repair portion comprises plastic.

9. The golf tool of claim 1, wherein the golf club adjustment portion comprises steel.

* * * * *